US009368338B2

(12) United States Patent
Dolgov

(10) Patent No.: US 9,368,338 B2
(45) Date of Patent: Jun. 14, 2016

(54) GAS DISCHARGE LAMP WITH AN AXIALLY EXTENDING STRIP OF GETTER AND METHOD OF MANUFACTURE

(75) Inventor: Boris Dolgov, Longmont, CO (US)

(73) Assignee: Mocon, Inc., Minneapolis, MN (US)

( * ) Notice: Subject to any disclaimer, the term of this patent is extended or adjusted under 35 U.S.C. 154(b) by 637 days.

(21) Appl. No.: 13/493,027

(22) Filed: Jun. 11, 2012

(65) Prior Publication Data

US 2012/0318996 A1 Dec. 20, 2012

Related U.S. Application Data

(60) Provisional application No. 61/497,762, filed on Jun. 16, 2011.

(51) Int. Cl.

| | |
|---|---|
| ***H01J 7/18*** | (2006.01) |
| ***H01J 61/26*** | (2006.01) |
| ***H01J 65/04*** | (2006.01) |

(52) U.S. Cl.

CPC ..... *H01J 61/26* (2013.01); *H01J 65/046* (2013.01)

(58) Field of Classification Search

CPC ..... H01J 61/26; H01J 65/046
USPC ..... 313/547, 549
See application file for complete search history.

(56) References Cited

U.S. PATENT DOCUMENTS

| | | | | |
|---|---|---|---|---|
| 3,749,467 | A * | 7/1973 | Emidy et al. | 445/26 |
| 3,946,262 | A * | 3/1976 | Keeffe et al. | 313/562 |
| 4,818,915 | A | 4/1989 | Zaslavsky et al. | |
| 5,017,831 | A * | 5/1991 | Bouchard et al. | 313/558 |
| 5,444,331 | A * | 8/1995 | Matsuno et al. | 313/553 |
| 6,646,444 | B2 | 11/2003 | Dolgov et al. | |
| 2005/0046331 | A1* | 3/2005 | Kim et al. | 313/493 |
| 2005/0062398 | A1* | 3/2005 | Yoshida et al. | 313/486 |
| 2005/0218811 | A1 | 10/2005 | Schulman | |
| 2006/0226781 | A1* | 10/2006 | Allen et al. | 313/594 |
| 2011/0101858 | A1 | 5/2011 | Hombach et al. | |

FOREIGN PATENT DOCUMENTS

| | | |
|---|---|---|
| EP | 0599581 A1 | 6/1994 |
| JP | 02-094230 | 4/1990 |
| JP | 10-308174 | 11/1998 |
| JP | 11-250807 | 9/1999 |
| JP | 11-339729 | 12/1999 |
| JP | 2001-250503 | 9/2001 |
| JP | 2003-215103 | 7/2003 |
| JP | 2007-005317 | 1/2007 |
| JP | 2007-173090 | 7/2007 |
| JP | 2010-256165 | 11/2010 |

* cited by examiner

*Primary Examiner* — Nimeshkumar Patel
*Assistant Examiner* — Christopher Raabe
(74) *Attorney, Agent, or Firm* — Sherrill Law Offices, PLLC

(57) ABSTRACT

A gas discharge lamp, photoionization sensor employing the gas discharge lamp, and method of manufacturing the lamp. The lamp includes a longitudinally extending strip of getter within the housing.

The method of manufacture includes the steps of (i) obtaining a glass tube, (ii) constricting the tube intermediate the longitudinal ends to divide the bore into first and second chambers in fluid communication with one another through a passageway in the constriction, (iii) attaching an ultraviolet transparent window over the open end of the first chamber, (iv) inserting a strip of getter into the first chamber through the passageway in the constriction, (v) purging the first chamber with a noble gas, and (vi) heating the tube at the constriction to detach the first chamber from the second chamber and seal the constricted end of the first chamber.

12 Claims, 3 Drawing Sheets

GAS DISCHARGE LAMP WITH AN AXIALLY EXTENDING STRIP OF GETTER AND METHOD OF MANUFACTURE

This application claims the benefit of U.S. Provisional Application No. 61/497,762, filed Jun. 16, 2011.

BACKGROUND

Gas discharge lamps are used in a wide variety of applications to emit radiation falling within a defined band width. Radiation is emitted by the lamp by capacitively exciting a working gas retained within the lamp with a pair of excitation electrodes diametrically positioned on opposite sides of the lamp. One such gas discharge lamp is described in U.S. Pat. No. 6,646,444, the disclosure of which is incorporated herein by reference. Alternatively, the working gas can be inductively excited. As disclosed in U.S. Pat. No. 6,646,444, a preferred working gas is Krypton.

In order to maintain proper performance of a gas discharge lamp, the working gas needs to remain relatively pure. Contamination of the working gas within the lamp, such as from residual gases remaining within the lamp during manufacture or gradual release of adsorbed gases into the lamp, decreases operability and performance.

It is customary to incorporate a getter into gas discharge lamps in order to reduce or eliminate contamination gases within the lamp. Getters function by chemically combining with or adsorbing contaminant gases, thereby preventing them from interfering with excitation of and emissions from the working gas.

Getters, typically a metal foil such as titanium, are highly susceptible to oxidative degradation if heated while exposed to a high concentration of oxygen such as found in the atmosphere. Unfortunately, typical methods of constructing gas discharge lamps subject the getter incorporated into the lamp to temperatures in excess of 300 to 500° C. while they remain exposed to the atmosphere, resulting in degradation of the getter and loss of both performance and useful lifespan of the lamp.

Accordingly, a substantial need exists for an easy, inexpensive and reliable method of incorporating a getter into a gas discharge lamp without oxidative deactivation of the getter.

SUMMARY OF THE INVENTION

A first aspect of the invention is a gas discharge lamp, such as an ultraviolet lamp. The lamp includes (a) a housing, preferably glass, defining a longitudinal axis and containing a gas, preferably krypton, sealed within the housing, (b) an ultra-violet transparent window through a first longitudinal end of the housing, and (c) a longitudinally extending strip of getter, preferably titanium, within the housing.

The gas discharge lamp preferably includes a pair of metal excitation electrodes diametrically positioned about the longitudinal axis on or within the housing.

A second aspect of the invention is a photoionization sensor that includes an ultraviolet gas discharge lamp according to the first aspect of the invention.

A third aspect of the invention is a method of constructing a gas discharge lamp. The method includes the steps of (i) obtaining a glass tube having open first and second longitudinal ends and a longitudinally extending bore, (ii) constricting the glass tube intermediate the first and second longitudinal ends of the tube so as to divide the bore into a first chamber proximate the first longitudinal end of the tube and a second chamber proximate the second longitudinal end of the tube with the chambers in fluid communication with one another via a passageway through the constriction, (iii) attaching an ultraviolet transparent window to the tube over the open first longitudinal end of the tube, (iv) inserting a strip of getter into the first chamber from the second longitudinal end of the tubing, (v) purging the first chamber with a noble gas, and (vi) heating the tube at the constriction to detach the first chamber from the second chamber and seal the constricted end of the first chamber.

DETAILED DESCRIPTION OF A PREFERRED EMBODIMENT

Definitions

As utilized herein, including the claims, the phrase "aspect ratio" means the ratio of length to the larger of width or thickness.

As utilized herein, including the claims, the phrase "high aspect ratio" means an aspect ratio of greater than 5:1.

NOMENCLATURE

Figure 1:
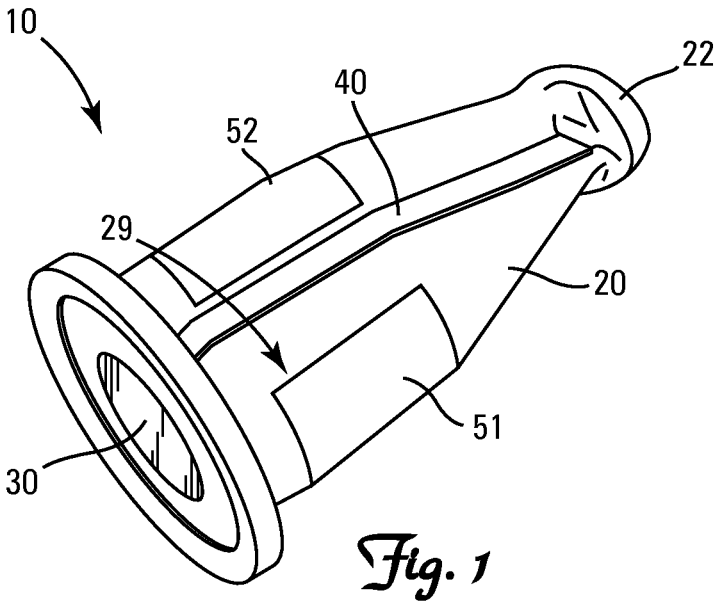
FIG. 1 is a perspective view of one embodiment of the invention.
Figure 2:
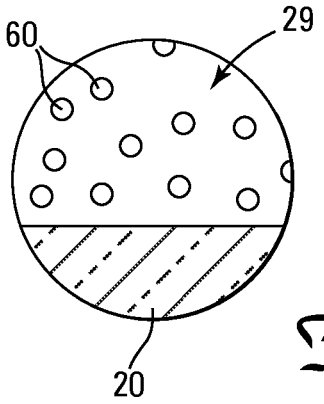
FIG. 2 is a grossly enlarge portion of the invention shown in FIG. 1 permitting depiction of the working gas on a molecular level.
Figure 3A:
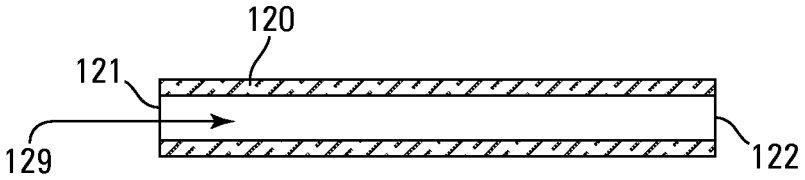
FIG. 3*a* is a cross-sectional side view of a glass tube used in construction of the invention shown in FIG. 1.
Figure 3B:
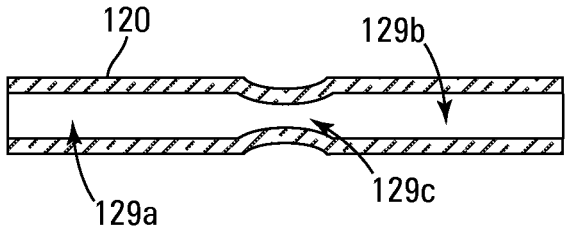
FIG. 3*b* is a cross-sectional side view of the glass tube shown in FIG. 3*a* after constriction.
Figure 3C:
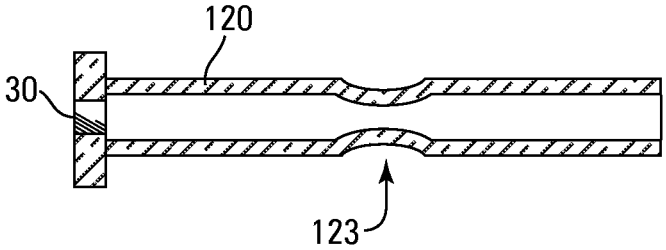
FIG. 3*c* is a cross-sectional side view of the constricted glass tube shown in FIG. 3*b* after attachment of the ultraviolet transparent window.
Figure 3D:
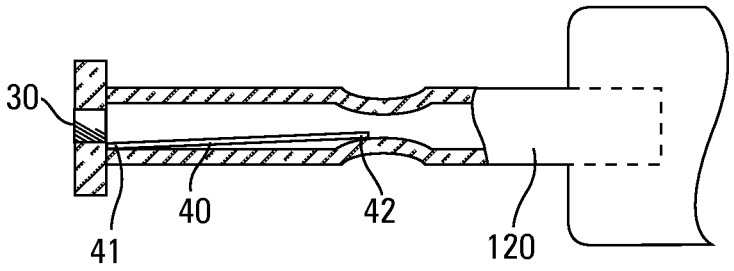
FIG. 3*d* is a partial cross-sectional side view of the windowed and constricted glass tube shown in FIG. 3*c* after "dropping" the getter strip into the tube and mounting the tube to a gas purge station.
Figure 3E:
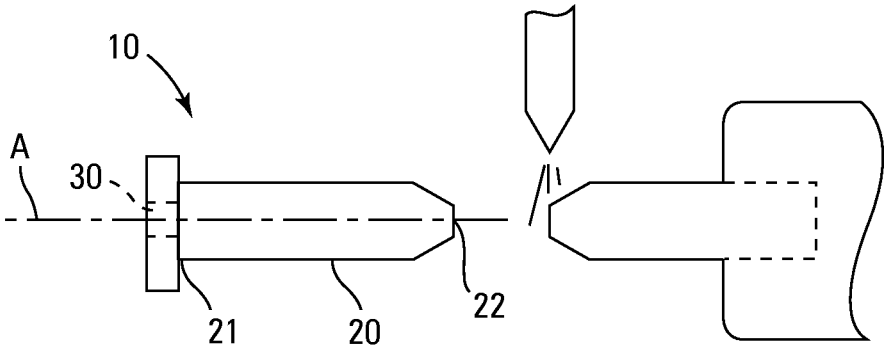
FIG. 3*e* is a side view of the getter-containing windowed and constricted glass tube during thermal separation of the tube.

10 Gas Discharge Lamp
20 Lamp Housing
21 First Longitudinal End of Lamp Housing
22 Second Longitudinal End of Lamp Housing
29 Chamber of Lamp Housing
30 Ultra Violet Transparent Window
40 Getter Strip
41 First Longitudinal End of Getter
42 Second Longitudinal End of Getter
50 Excitation Electrodes
51 First Excitation Electrode
52 Second Excitation Electrode
60 Working Gas
120 Glass Tube
121 First Longitudinal End of Glass Tube
122 Second Longitudinal End of Glass Tube
123 Constriction on Glass Tube
129 Bore of Glass Tube
129*a* First Chamber Portion of Bore
129*b* Second Chamber Portion of Bore
129*c* Passageway Through Constriction A Longitudinal Axis Construction Referring to FIG. 1, the invention is directed to a gas discharge lamp 10, such as an ultraviolet discharge lamp 10 suitable for use in a photoionization sensor (not shown), having a housing 20, a working gas 60 sealed within the housing, an ultra-violet transparent window 30 attached to the first longitudinal end 21 of the housing 20, a pair of metal excitation electrodes 51 and 52 (collectively referenced as electrodes 50) diametrically positioned about the longitudinal axis A on or within the housing 20, and a longitudinally extending strip of getter 40 within the housing 20.

The housing 20 is preferably constructed of glass. A preferred ultra-violet transparent window 30 is a cap constructed from magnesium fluoride crystals. The getter 40 is preferably constructed from an oxidizable metal such as titanium or a sintered getter alloy. The electrodes 50 are preferably attached to the outside surface of the housing 20. The working gas 60 is preferably a noble gas, most preferably krypton. Hydrogen can also be used as the working gas.

The getter 40 is a longitudinally elongated strip, preferably having a high aspect ratio of longitudinal length to width. Use of a getter strip 40 with a high aspect ratio allows the getter strip 40 to be inserted into the chamber 29 of the housing 20 through the constricted second longitudinal end 22 of the housing 20 after the ultraviolet transparent window 30 has been attached to the housing 20. The getter strip 40 is configured and arranged within the housing 20 so that the long dimension of the getter strip 40 (i.e., longitudinal length) extends longitudinally A within the housing 20. The getter strip 40 is preferably sized so that when the first longitudinal end 41 of the getter strip 40 touches the ultraviolet transparent window 30 on the first longitudinal end 21 of the housing 20, the second longitudinal end 42 of the getter strip 40 extends into the constricted second longitudinal end 22 of the housing 20. The second longitudinal end 42 of the getter strip 40 is preferably embedded within the housing 20 to fix the position of the getter strip 40 within the chamber 29.

Manufacture

The lamp 10 can be constructed by a method which prevents oxidative degradation of the getter strip 40. Referring to FIGS. 3*a-e*, the method includes the steps of (i) obtaining a glass tube 120 having open first 121 and second 122 longitudinal ends and a longitudinally extending bore 129 (FIG. 3*a*), (*b*) forming a constriction 123 in the glass tube 120 intermediate the first 121 and second 122 longitudinal ends of the tube 120 so as to divide the bore 129 into a first chamber 129*a* proximate the first longitudinal end 121 of the tube 120 and a second chamber 129*b* proximate the second longitudinal end 122 of the tube 120 with the chambers 129*a* and 129*b* in fluid communication with one another via a passageway 129*c* through the constriction 123 (FIG. 3*b*), (*c*) attaching (e.g., soldering) an ultraviolet transparent window 30 to the tube 120 over the open first longitudinal end 121 of the tube 120, (d) inserting a strip of getter 40 into the first chamber 129*a* through the open second longitudinal end 122 of the tubing 120 and through the constriction passageway 129*c* (FIG. 3*c*), (*e*) purging the first chamber 129*a* with a working gas 60 such as a noble gas (FIG. 3*d*), (*f*) heating the tube 120 at the constriction 123 to detach the first chamber 129*a* from the second chamber 129*b* and seal the constricted end 22 of the first chamber 129*a* (FIG. 3*e*), and (g) forming excitation electrodes 50 on the portion of the tube 120 defining the first chamber 129*a*.

The first chamber 129*a* is preferably purged with working gas 60 by evacuating the gaseous content of the chamber 129*a* (e.g., pulling a vacuum) and then filling the evacuated chamber 129*a* with working gas 60.

By dividing the tubing 120 after purging the first chamber 129*a*, oxidative degradation of the getter strip 40 is avoided as the getter strip 40 is not exposed to atmospheric oxygen while the tube 120 is heated.

The getter strip 40 is preferably fixed within the first chamber 129*a* by embedding the second longitudinal end portion 42 of the getter strip 40 within the constricted end of the first chamber 129*a* during heating of the constriction 123 on the glass tube 120 to separate the first chamber 129*a* from the second chamber 129*b*.

I claim:

1. A gas discharge lamp containing a getter spared heat-induced oxidative degradation during assembly of the gas discharge lamp, comprising:

(a) a housing defining a longitudinal axis and containing a gas sealed within a lumen of the housing, (b) an ultra-violet transparent window through a first longitudinal end of the housing, and (c) a longitudinally extending strip of getter within the lumen of the housing, wherein the getter is getter that has been spared heat-induced oxidative degradation during assembly of the gas discharge lamp by subjecting the getter within the lumen of the housing to heat during assembly of the gas discharge lamp only after removing oxygen from the lumen of the housing.

2. The lamp of claim 1 further comprising a pair of metal excitation electrodes diametrically positioned about the longitudinal axis on or within the housing.

3. The lamp of claim 1 wherein the lamp is an ultraviolet lamp.

4. The lamp of claim 1 wherein the housing is glass.

5. The lamp of claim 1 wherein the getter is titanium.

6. The lamp of claim 1 wherein the strip of getter has a high aspect ratio with a longitudinally extending length.

7. A photoionization sensor including an ultraviolet gas discharge lamp in accordance with claim 1.

8. A photoionization sensor including an ultraviolet gas discharge lamp in accordance with claim 2.

9. A photoionization sensor including an ultraviolet gas discharge lamp in accordance with claim 3.

10. A photoionization sensor including an ultraviolet gas discharge lamp in accordance with claim 4.

11. A photoionization sensor including an ultraviolet gas discharge lamp in accordance with claim 5.

12. A photoionization sensor including an ultraviolet gas discharge lamp in accordance with claim 6.

* * * * *